US005567261A

United States Patent [19]

Schoetz

[11] Patent Number: 5,567,261

[45] Date of Patent: Oct. 22, 1996

[54] METHOD AND APPARATUS FOR DECORATING ARTICLES HAVING A CONICAL PERIPHERAL SURFACE PORTION

[75] Inventor: Claus Schoetz, Fuerth, Germany

[73] Assignee: Leonhard Kurz GmbH & Co., Fuerth, Germany

[21] Appl. No.: 334,219

[22] Filed: Nov. 4, 1994

Related U.S. Application Data

[63] Continuation-in-part of Ser. No. 88,321, Jul. 7, 1993, abandoned.

[30] Foreign Application Priority Data

Aug. 6, 1992 [DE] Germany ..... 42 26 002.7

[51] Int. Cl.[6] ..... B44C 1/17

[52] U.S. Cl. ..... 156/238; 156/240; 156/361; 156/540; 156/447; 156/486

[58] Field of Search ..... 156/234, 234, 156/238, 240, 361, 538, 540, 366, 568, 447, 448, 486

[56] References Cited

U.S. PATENT DOCUMENTS

| | | | |
|---|---|---|---|
| 3,619,402 | 11/1971 | Wurm et al. | 204/298 |
| 3,661,075 | 5/1972 | Amberg | 101/40 X |
| 4,332,635 | 6/1982 | Holbrook | 156/256 |
| 4,455,182 | 6/1984 | Roth | 156/215 |
| 4,512,734 | 4/1985 | Dronet | 425/305.1 |
| 4,832,783 | 5/1989 | Nechay | 156/448 |
| 5,192,391 | 3/1993 | Kummerer | 101/25 X |

*Primary Examiner*—David A. Simmons
*Assistant Examiner*—Steven J. Helmer
*Attorney, Agent, or Firm*—Louis E. Marn, Esq.

[57] ABSTRACT

In a method and apparatus for decorating articles having at least a generally conical surface portion with a decoration on a stamping foil, the foil passes around a guide roller as it is fed towards the stamping roller for applying a decoration on the foil to the surface portion of the article. The guide roller is displaced by a drive means along an arcuate guide means into a position adapted to the respective rotary angular position of the article to be decorated. The drive means for driving the stamping roller is inoperable to drive same during the stamping operation so that the stamping roller is only driven by frictional engagement during the stamping operation.

6 Claims, 1 Drawing Sheet

METHOD AND APPARATUS FOR DECORATING ARTICLES HAVING A CONICAL PERIPHERAL SURFACE PORTION

CROSS REFERENCE TO RELATED APPLICATION

This application is a continuation-in-part application of U. S. application Ser. No. 08/088,321, filed Jul. 7, 1993, abandoned.

BACKGROUND OF THE INVENTION

DESCRIPTION OF THE PRIOR ART

There are various situations which involve the application of a decoration, pattern, graphics or the like, referred to hereinafter for the sake of simplicity as decoration, to a generally conical peripheral surface portion of an article. It will be appreciated that the article may not be of a conical configuration throughout but for example may comprise a generally cylindrical portion and a conical portion, with the decoration having to be applied to the latter. One way of applying a decoration to a generally conical peripheral surface portion of such an article is to use a stamping foil, which can also be referred to as an embossing or transfer foil, for example a hot stamping foil. In one form of such a method, as is to be found in DE 39 31 556 C2, the foils which are successively provided with a plurality of said decorations are unwound from a supply roll and fed to a stamping station for receiving a respective article to be decorated. In that station the decoration is transferred from the foil on to the surface portion of the article by means of a stamping or applicator roller, referred to herein for the sake of simplicity as a stamping roller, having a cylindrical peripheral surface and being drivable by a suitable drive. The foil is guided around a direction-changing roller which is combined with the supply roll and which is disposed upstream of the stamping station in the direction of forward advance movement of the foil. From the direction-changing roller the foil is passed to the stamping station, with the direction-changing roller being displaced into a position which is suitably adapted to the rotary angular position of the respective article to which a decoration is to be applied from a foil.

In that method, the direction-changing roller is continuously linearly moved by a distance which corresponds to the respective difference between the linear path of movement of the stamping foil and the arc in respect of development of the conical peripheral surface of the article to be decorated, while at the same time the direction-changing roller is continuously pivoted in such a way as to compensate for the linear movement of the stamping foil in relation to the respective aperture angle of the arcuate development of the conical peripheral surface of the respective article. In a suitable form of apparatus for carrying out that method, the direction-changing roller is mounted on a mounting member rotatably about its longitudinal axis, while the mounting member is in turn connected by means of a pivot spindle to an adjusting platform. The platform is arranged for linear movement on a stationary base member, by means of a drive device, the mounting member having a sensing element guided slidably on a guide arrangement provided on the stationary base member. That design configuration therefore involves a number of structural members which slidably co-operate with each other and which therefore each involve a high degree of mechanical wear. The manufacture of all those individual components also means that the apparatus is costly.

Furthermore, in a stamping foil feed apparatus for a stamping machine, as is to be found in German published specification (DE-AS) No 27 21 908, which involves applying decoration by means of a stamping foil to a peripheral surface, in the form of a truncated pyramid, of an article which may be for example the casing of a television, the stamping foil is supplied from a supply roll which is displaceable axially and approximately parallel to the stamping or applicator roller of the stamping station. Between the supply roll and the stamping roller, prior to being applied to the corresponding surface of the article to be decorated, the stamping foil is guided over a guide roller which is displaceable approximately parallel to itself for tensioning the stamping foil and mounted rotatably about a transverse axis extending perpendicularly to the surface to be decorated, of the article. To produce that movement of the stamping foil as it passes from the supply roll to the stamping roller, the guide roller around which the stamping foil is passed and which is movable with the supply roll for the stamping foil can be in the form of a dancer roller, that is to say a roller which is freely movably mounted and which adapts itself automatically stepwise to the respective conditions of operation as governed by the stamping foil and the respective surface of the article to be decorated. The dancer roller will thus move in response to the varying tension produced in the stamping foil by virtue of the fact that the article to be decorated in this case has a plurality of flat surface portions, as it is of a truncated pyramid shape. The situation however is different when dealing with articles which have a conical peripheral surface, for example when dealing with articles of a frustoconical configuration. Such articles include for example cans for liquids or the like.

In a method of laterally guiding a moving web of material along a part of the path of movement thereof, as is to be found in German laid-open application (DE-OS) No 20 06 571, the web passes over a main web guide roller which can be pivoted in a plane of movement out of a neutral position in which the main web guide roller is oriented perpendicularly to the desired path of movement of the web. The lateral position of the web as it passes on to the main web guide roller is sensed at a sensing location upstream of the guide roller. The main web guide roller is pivoted out of its neutral position in such a direction that the deviation of the web from its desired path of movement is then suitably corrected. The web as it runs off the main web guide roller undergoes a change in direction as it passes over a discharge web guide roller and it runs off the latter at a location which is adjacent to a plane through the sensing location and perpendicular to the plane of movement of the main web guide roller. The discharge web guide roller is held parallel to the main web guide roller during the pivotal movement of the latter.

Finally, an apparatus for helically winding material in strip form around an article of a cylindrical or frustoconical configuration is disclosed in UK patent specification No 1 282 588.

SUMMARY OF THE INVENTION

An object of the present invention is to provide a method of decorating articles having at least a generally conical peripheral surface portion with a decoration of a stamping foil, which is such as to provide for accurate register of the decoration on the surface portion of the article, using comparatively simple means.

Another object of the present invention is to provide a method of applying a decoration from a stamping foil to a generally conical peripheral surface of an article, which affords reliable and accurate application of the decoration to the article in the correct intended position using an uncomplicated combination of movements.

Yet another object of the present invention is to provide an apparatus for decorating articles having at least a generally conical peripheral surface portion, which is reliable in operation in terms of proper application of the required decoration to the article while involving a small number of components and simple movements.

Still another object of the present invention is to provide an apparatus for applying a decoration to a generally conical peripheral surface of an article, which can provide for application of the decoration in accurate register relative to the surface of the article and which can be readily adapted to articles of different dimensions and configurations.

In accordance with a first aspect of the present invention, the foregoing and other objects are achieved by a method of decorating articles having at least a generally conical peripheral surface portion with a decoration from a stamping foil, the foils which are successively provided with a plurality of said decorations being unwound from a supply roll and fed to a stamping or applicator station for receiving a respective article to be decorated. In that station the decoration is transferred from the foil on to the surface portion of the article by means of a stamping or applicator roller having a cylindrical peripheral surface and drivable by a first drive means. The foil is guided around a direction-changing guide roller which is combined with the supply roll and which is disposed upstream of the station in the direction of the forward advance movement of the foil. From the guide roller the foil is passed to the stamping station. The guide roller is displaced into a position which is adapted to the respective rotary angular position of the article to be decorated, being moved by means of a second drive means along an arcuate guide arranged in a plane defined by the common generatrix of the cylindrical peripheral surface of the stamping roller and said surface portion of the article. The center of curvature of the arcuate guide is disposed on the common generatrix of the stamping roller and the article. During the stamping operation the article is driven by an associated third drive means and the stamping roller is uncoupled from its first drive means which serves for positioning purposes, and is then driven only by frictional engagement.

In a further aspect of the invention the foregoing and other objects are achieved by an apparatus for decorating articles having at least a generally conical peripheral surface portion with a decoration of a stamping foil, comprising a supply roll means for the stamping foil which is successively provided with a plurality of decorations, a stamping station for receiving a respective article to be decorated, the stamping station having a holding means for holding a said article supplied to said station and a stamping roller having a cylindrical peripheral surface. The stamping roller may be a heatable roller. The apparatus further includes a first drive means for driving the stamping roller to position it relative to a said foil in said station. A direction-changing guide roller is disposed upstream of said station in the direction of forward feed movement of the foil thereto, the guide roller being combined with the supply roll. The apparatus has a displacement means for displacing the guide roller into a position suited to the respective rotary angular position of the article to be decorated, the displacement means including an arcuate guide means arranged in a plane defined by the common generatrix of the cylindrical peripheral surface of the stamping roller and the conical peripheral surface portion of the article. A second drive means is operable to displace the guide roller along the guide means, the guide means having a center of curvature disposed at said common generatrix of the stamping roller and the article and the guide means having a portion which is oriented parallel to said common generatrix and extending away from said portion at the side of the article which is remote from the intersection of the generatrices of the article. A third drive means is operable to drive the holding means for the article. As will be seen in greater detail from a preferred embodiment of the invention as described hereinafter, only a simple arcuate guide means is required, along which the direction-changing guide roller is movable by the second drive means, to provide for proper positioning of the guide roller relative to the article to which a decoration is to be applied. Such a guide means can be very easily produced, in comparison with the various interlockingly co-operating component parts of the apparatus disclosed in above-mentioned DE 39 31 556 C2, while in addition the overall arrangement provides a comparatively long service life with a high degree of accuracy in terms of proper coordination of the movements involved. By virtue of the fact that during the stamping operation the article to be decorated is driven by the associated third drive means, by way of the means holding the article in the stamping station, and as the stamping or applicator roller is uncoupled from the associated first drive means which thus only serve for positioning of the stamping roller prior to the actual stamping operation, with the stamping roller then being driven only by frictional engagement, the method and apparatus according to the present invention have the advantage that it is readily possible to apply decoration in accurate register to different conical articles, for example articles of different dimensions and involving different conical configurations, using one and the same apparatus and one and the same operating procedure.

In a preferred feature of the invention, the center of curvature of the arcuate guide means does not lie just on the common generatrix of the stamping roller and the article to be decorated, but more specifically in a middle region of that generatrix. It is then possible for the stamping foil to be fed to the conical article to be decorated, perpendicularly to the axis thereof, so that the stamping operation can then be carried out.

In accordance with a preferred feature the apparatus includes a regulating means connected to the first, second and third drive means in such a way that, during the starting operation, the first drive means is uncoupled from the stamping roller and at the same time, by the second drive means, the guide roller is suitably displaced along the guide means and the article is suitably driven by the third guide means while the stamping roller is uncoupled from the first drive means and is driven only by frictional engagement. So that the respective drive means can be suitably driven by an electronic regulating means, in a preferred feature of the invention the drive means include electric motors.

Further features, details and advantages of the present invention will be apparent from the following description of a preferred embodiment of the invention.

DESCRIPTION OF THE PREFERRED EMBODIMENT

Figure 1:
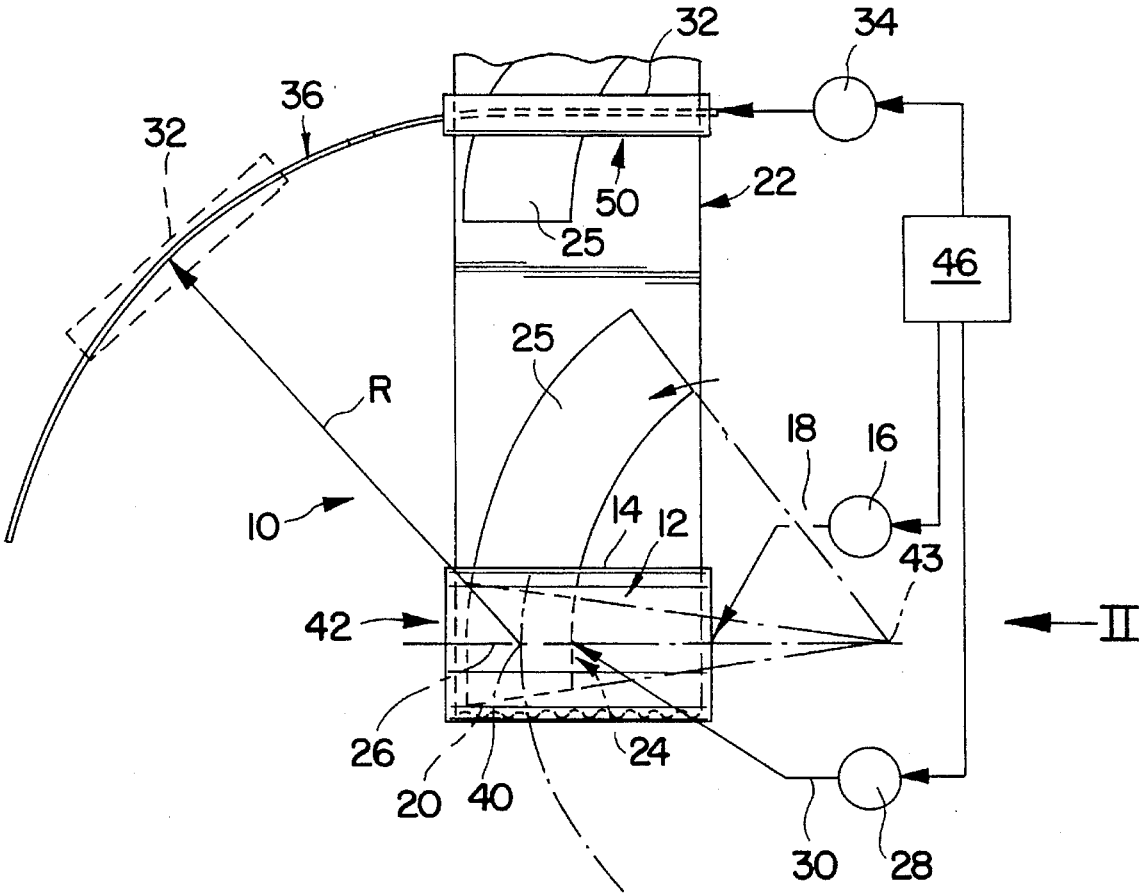
FIG. 1 is a diagrammatic block diagram of the major components of an apparatus according to the invention.

Referring firstly to FIG. 1, diagrammatically shown therein in plan is an apparatus 10 for applying decoration to a conical peripheral surface portion of an article, comprising a stamping or applicator roller 12 having a cylindrical peripheral surface 14. The stamping roller 12 can be heated and for the purposes of suitable positioning thereof can be driven by a first drive means diagrammatically indicated at 16. The drive communication between the drive means 16 and the roller 12 is indicated by arrow 18.

Figure 2:
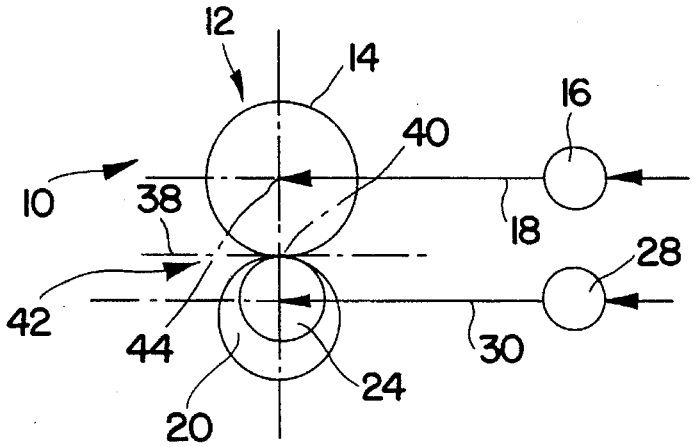
FIG. 2 is a view looking in the direction indicated by the arrow II in FIG. 1 onto the stamping roller of the apparatus and an article to be decorated, with diagrammatically indicated drive means.

Referring now also to FIG. 2 in which the same features and components are denoted by the same references as in FIG. 1, an article 24 having a generally conical peripheral surface 20 to which a decoration 25 is to be applied from a stamping foil indicated generally as 22 in FIG. 1, in the form of a strip, is applied against the cylindrical peripheral surface 14 of the roller 12. In FIG. 1, the article 24 is disposed beneath the roller 12 and is consequently identified therein by broken lines. The conical article 24 bears with a generatrix indicated at 26 against the cylindrical peripheral surface 14 of the roller 12, more specifically a generatrix thereof. The article 24 is carried by a holding means drivable by a third drive means diagrammatically indicated at 28 in FIGS. 1 and 2. The drive connection between the drive means 28 and the article 24 in the holding means is indicated by the arrow 30 in FIGS. 1 and 2.

In operation of the apparatus the foil 22 is unwound from a supply roll (not visible in the drawing) and diverted around a direction-changing guide roller 32 which is combined with the supply roll and which is movable by a second drive means diagrammatically indicated at 34 in FIG. 1 along an arcuate guide means 36. The arcuate guide means 36 is disposed in the plane defined by the common generatrix 26 of the cylindrical peripheral surface 14 of the roller 12 and the conical peripheral surface portion 20 of the article 24, that plane being perpendicular to the plane of the drawing in FIG. 2 through a dash-dotted line indicated at 38 in FIG. 2. The guide means 36 has a radius of curvature as indicated at R in FIG. 1, the center of curvature 40 thereof lying on the generatrix 26. Preferably, the center of curvature 40 is disposed in the middle region of the common generatrix 26 of the article 24 so that at the beginning of the stamping operation for applying a decoration from the foil 22 to the surface portion 20 of the article 24, it is possible for the foil 22 to be fed to the stamping station as indicated at 42 in FIG. 2 between the roller 12 and the article 24, perpendicularly to the axis as indicated at 44 in FIG. 2 of the roller 12 and perpendicularly to the common generatrix 26.

The first drive means 16, the second drive means 34 and the third drive means 28 are connected to a preferably electronic regulating means 46 which is diagrammatically indicated by a block in FIG. 1. The regulating means 46 is provided to switch off the first drive means 16 and consequently the drive for the roller 12 during the stamping operation, while simultaneously the guide roller 32 is driven by the second drive means 34 and the holding means holding the article 24 in the stamping station 42 is driven by the third drive means 28, in such a way that the guide roller 32 and the article 24 are suitably adapted to each other to ensure that the decoration is properly applied to the article 24. It will thus be seen that during the stamping operation for applying the decoration to the article 24 from the foil 22 the roller 12 is not driven by its associated drive means but only by frictional engagement, so that the drive means 16 serves for the purposes of positioning the roller 12 relative to the foil 22 in the stamping station 42. This arrangement serves to prevent over definition of the movement of the guide roller 32 and the foil 22 respectively, and in this way it is possible to provide for accurate application of decoration to articles of any dimensions and/or conical configurations.

FIG. 1 schematically shows in thin dash-dotted lines a further intermediate position of the guide roller 32 on the arcuate guide means 36 and the corresponding position of the foil 22 for suitably applying the decoration 25 to the conical article 24 at its peripheral surface portion 20.

It will also be seen from FIG. 1 that two generatrices of the conical article 24 are shown in thin lines, intersecting at a common point of intersection 48. The arcuate guide means 36 extends with a portion 50 which is oriented at least substantially parallel to the common generatrix 26 of the roller 12 and the conical or frustoconical article 24, and extends away from that portion on the side of the article, which is remote from the intersection 48 of the generatrices of the article 24. The decorations 25 on the stamping foil 22 have an outer curved edge 25A and an inner curved edge 25B wherein curvature is defined by the common point 48 of the intersection of the generatrices of the conical article 24 being decorated.

It will be understood therefore from the foregoing description of the apparatus according to the invention, and the method of applying a decoration to the article 24, that the first drive means 16 serves to drive the roller 12 for positioning it in accurate register relationship with respect to the decoration on the foil 22. As soon as that positioning operation has been carried out, the first drive means can be uncoupled from the roller 12, for example, by switching off the drive means, so that the roller 12 is then further driven only by frictional engagement with the article to be decorated, at its conical peripheral surface. The arcuate guide means 36 along with the guide roller 32 and therewith the foil 22 is moved relative to the stamping station 42 in the plane defined by the common generatrix of the cylindrical peripheral surface of the roller 12 and the conical peripheral surface portion 20 of the article 24, so as to prevent unintentional curving or buckling of the foil as it passes into the station 42. The foil 22 therefore passes in the above-mentioned accurately defined plane into the station 42, that is to say into the stamping gap defined by the common generatrix of the roller 12 and the conical article 22, and is displaced counterclockwise along the arcuate guide means 36, in a manner corresponding to the rotary movement of the article 24 to which the decoration 25 is to be applied from the foil 22. During such movement, the curved edges 25A and 25B of the decoration 25 are limited to the common generatrix 26.

The foil 22 is accurately fed to the stamping station 42 perpendicularly to the above-mentioned generatrix when the guide roller 32 is on the portion of the guide means 36, which is parallel to the generatrix 26. Subsequently thereto, the foil 22 is fed to the station 42 at a varying angle relative to the generatrix, in accordance with the counterclockwise movement of the guide roller 32 along the guide means 36. The varying angle corresponds to the respective rotary angular position of the article 24 to which the decoration 25 is being applied, that is to say the respective portion of the development of the conical peripheral surface 20 of the article 24 with the decoration 25.

It will be appreciated that the above-described method and apparatus according to the invention have been set forth solely by way of example and illustration thereof and that various modifications and alterations may be made therein without thereby departing from the spirit and scope of the present invention.

What is claimed is:

1. A method of decorating articles having at least a generally conical peripheral surface portion with a decoration of a stamping foil, wherein the foil which is successively provided with a plurality of said decorations is unwound from a supply roll and fed to a stamping station for receiving a respective article to be decorated, in which station the decoration is transferred from the foil on to said surface portion of said article by means of a stamping roller having a cylindrical peripheral surface and drivable by a first drive means; wherein said foil is guided around a direction-changing guide roller which is combined with the supply roll and which is arranged upstream of said station in the direction of forward feed movement of said foil; wherein the foil is passed from said guide roller to said station; wherein the guide roller is displaced into a position which is adapted to the respective rotary angular position of said article to be decorated, by said guide roller being moved by a second drive means along an at least substantially arcuate guide means arranged in a plane containing the common generatrix of the cylindrical peripheral surface of the stamping roller and said surface portion of said article, the plane further being tangent to the cylindrical peripheral surface of the stamping roller, the center of curvature of said guide means being disposed at said common generatrix of said stamping roller and said article; wherein during the stamping operation said article is driven by an associated third drive means and said stamping roller is undriven by said first drive means which serves for positioning of said stamping roller prior to the stamping operation during which the stamping roller is driven only by frictional engagement.

2. Apparatus for decorating articles having at least a generally conical peripheral surface portion with a decoration of a stamping foil, comprising a supply roll for the foil which is successively provided with a plurality of decorations, a stamping station for receiving the respective article to be decorated, said station having a holding means for said article and a stamping roller having a cylindrical peripheral surface, means for heating said stamping roller, a first drive means for driving said stamping roller to position same relative to a said foil in said station, a direction-changing guide roller upstream of said station in the direction of forward feed movement of said foil, the guide roller being combined with the supply roll, a displacement means for displacing said guide roller into a position suited to the respective rotary angular position of the article to be decorated at said station, the displacement means including an at least substantially arcuate guide means arranged in a plane containing the common generatrix of the cylindrical peripheral surface of said stamping roller and the conical peripheral surface portion of said article, said guide means having a center of curvature disposed at a point on said common generatrix of said stamping roller and said article, the plane further being tangent to the cylinder peripheral surface of the stamping roller, and said guide means having a portion which is oriented parallel to said common generatrix and extending away from said portion at the side of said article which is remote from the intersection of the generatrices of said article, a second drive means for displacing said guide roller along said guide means, and a third drive means for driving the holding means for said article.

3. Apparatus as set forth in claim 2 wherein said center of curvature lies in a middle region of said generatrix of said article.

4. Apparatus as set forth in claim 2 and further including a regulating means, and means connecting said first, second and third drive means to said regulating means in such a way that during said stamping operation the first drive means is inoperable to drive said stamping roller and simultaneously said guide roller is displaced along said guide means by said second drive means and said article to be decorated is driven by said third drive means, said stamping roller being driven only by frictional engagement.

5. Apparatus as set forth in claim 2 wherein each said drive means includes an electric motor.

6. Apparatus for decorating articles having at least a generally conical peripheral surface portion with a decoration from a stamping foil which is successively provided with a plurality of decorations, comprising a stamping station for receiving a respective article to be decorated, said station including a stamping roller having a cylindrical peripheral surface adapted to press a said decoration on said foil against the surface portion of a respective article, a first drive means for driving said stamping roller to position said stamping roller relative to a said decoration on said foil in said station, a direction-changing guide roller disposed upstream of said station in the direction of forward feed movement of said foil to said station, a displacement means for displacing said guide roller into a position suited to the respective rotary angular position of said article in said station, said displacement means including an at least substantially arcuate guide means disposed in a plane containing by the common generatrix of the cylindrical peripheral surface of said stamping roller and the conical peripheral surface portion of said article in said station, the plane further being tangent to the cylindrical peripheral surface of the stamping roller, said guide means having a center of curvature at point on said common generatrix and said guide means including a portion which is oriented at least substantially parallel to said common generatrix and said guide means extending away from said portion at the side of said station which is remote from the intersection of the generatrices of the surface portion of said article in said station, a second drive means for displacing said guide roller along said guide means, and a third drive means for driving said article in said station in rotation for application of said decoration to said article from said foil by co-operation with said stamping roller, the arrangement being such that the first drive means serves for positioning of said stamping roller for carrying out the stamping operation and the stamping roller is driven only by frictional engagement during the stamping operation.

* * * * *